US005732622A

United States Patent [19]

Lauderbaugh

[11] Patent Number: 5,732,622

[45] Date of Patent: Mar. 31, 1998

[54] MACHINE FOR MANUGACTURING CORRUGATED BOARD

[75] Inventor: David Lauderbaugh, Rosewell, Ga.

[73] Assignee: Corrugated Gear and Services, Alpharetta, Ga.

[21] Appl. No.: 788,923

[22] Filed: Jan. 24, 1997

[51] Int. Cl.[6] ..... B30B 15/34; B30B 5/02; B30B 5/04

[52] U.S. Cl. ..... 100/306; 100/48; 100/154; 100/211; 100/226; 100/269.03; 100/309; 100/324; 156/470; 156/583.5

[58] Field of Search ..... 100/48, 151–154, 100/211, 226, 237, 266, 269.02–269.04, 306, 309, 324; 156/206, 470, 581, 583.5

[56] References Cited

U.S. PATENT DOCUMENTS

| | | | |
|---|---|---|---|
| 633,665 | 9/1899 | Spaulding . | |
| 697,287 | 4/1902 | Spaulding . | |
| 905,076 | 11/1908 | Hinde . | |
| 2,252,585 | 8/1941 | Swanson et al. . | |
| 2,300,982 | 11/1942 | Slagboom et al. . | |
| 2,394,941 | 2/1946 | Smith . | |
| 2,508,216 | 5/1950 | Bonds et al. . | |
| 2,554,968 | 5/1951 | Thompson . | |
| 2,941,573 | 6/1960 | Cassady . | |
| 2,981,307 | 4/1961 | Malarkey, Jr. | 100/154 |
| 3,190,215 | 6/1965 | Howard et al. . | |
| 3,217,425 | 11/1965 | Nikkel . | |
| 3,319,353 | 5/1967 | Matsunami et al. . | |
| 3,434,901 | 3/1969 | Griffiths et al. . | |
| 3,444,029 | 5/1969 | Renaud et al. . | |
| 3,468,734 | 9/1969 | Shields . | |
| 3,580,795 | 5/1971 | Eichenlaub . | |
| 3,607,523 | 9/1971 | McGirr . | |
| 3,676,268 | 7/1972 | Brandenburg et al. . | |
| 3,753,838 | 8/1973 | Brandenburg . | |
| 3,783,097 | 1/1974 | Justus . | |
| 3,829,338 | 8/1974 | Hayasi . | |

(List continued on next page.)

FOREIGN PATENT DOCUMENTS 2233935 1/1991 United Kingdom .

OTHER PUBLICATIONS

A Practical Solution to Double Facer Problems, Technical Report, International Paper Board Industry, pp. 34–36, Jan. 1993.

"*Short Press" Heat Transfer System, A Retrofit for Existing Double Facers,* SCM Container Machinery, 19 pages, No Date.

Curley, *Double Backer Developments: Change is the Constant at Schiffenhaus Industries,* Board Converting News, vol. 9, No. 18, 4 pages (May 24, 1993).

Curley, Jim, "*At Williamette Sheet Feeder: New Doublebacker Brings Improved Quality*", Board Converting News, Aug. 12, 1996, pp. 6, 16–20.

Hyland Tricia, "*New Technology Makes Olympic–Sized Leap*", Official Board Markets, Aug. 3, 1996, pp. 8–9.

*Primary Examiner*—Stephen F. Gerrity

*Attorney, Agent, or Firm*—Jones & Askew, LLP

[57] ABSTRACT

A machine for manufacturing corrugated board including one or more flexible, disposable covers for the pressure-applying feet of the machine. The covers prevent wear and tear to the bottoms of the pressure-applying feet and may be easily replaced, as needed. In a belt-driven machine, the disposable covers may be located between the pressure-applying feet and the conveyor belt. In a machine with a beltless hotplate section, the conveyor belt is replaced by a pulling section located downstream from the hotplate section and the disposable covers may be located between the pressure-applying feet and the moving surface. The covers allow the thickness of the corrugated board to be varied while the board is moving through the machine without causing the leading edge of an added layer to catch on the upstream edges of the pressure-applying feet. In addition, the covers and/or the pressure applicators may be moved in the cross-machine direction to minimize waste when manufacturing different widths of corrugated board. For a zone-actuated machine, a separate cover may be provided for each zone of pressure applicators.

18 Claims, 6 Drawing Sheets

U.S. PATENT DOCUMENTS

| | | | |
|---|---|---|---|
| 3,981,758 | 9/1976 | Thayer et al. . | |
| 4,042,446 | 8/1977 | Lawton . | |
| 4,049,485 | 9/1977 | Iversen . | |
| 4,079,617 | 3/1978 | Whiting . | |
| 4,080,241 | 3/1978 | Grevich et al. . | |
| 4,101,370 | 7/1978 | Russell . | |
| 4,128,677 | 12/1978 | Hoelzinger . | |
| 4,268,341 | 5/1981 | Huhne . | |
| 4,286,490 | 9/1981 | Spengler . | |
| 4,306,932 | 12/1981 | Bradatsch et al. . | |
| 4,316,755 | 2/1982 | Flaum et al. . | |
| 4,467,537 | 8/1984 | Trotscher . | |
| 4,816,103 | 3/1989 | Ernest . | |
| 4,887,362 | 12/1989 | Rautakorpi . | |
| 5,005,473 | 4/1991 | Ishibashi . | |
| 5,121,683 | 6/1992 | Biefeldt | 100/324 |
| 5,122,220 | 6/1992 | Seki . | |
| 5,181,330 | 1/1993 | Schoch . | |
| 5,183,525 | 2/1993 | Thomas . | |
| 5,256,240 | 10/1993 | Shortt . | |
| 5,261,997 | 11/1993 | Inselmann . | |
| 5,337,656 | 8/1994 | Hollnagel . | |
| 5,340,432 | 8/1994 | Schulz et al. . | |
| 5,344,520 | 9/1994 | Seki et al. . | |
| 5,360,506 | 11/1994 | Thomas . | |
| 5,437,752 | 8/1995 | Lang . | |
| 5,456,783 | 10/1995 | Sissons . | |
| 5,466,329 | 11/1995 | Marschke . | |
| 5,501,762 | 3/1996 | Marschke et al. . | |
| 5,526,739 | 6/1996 | Lauderbaugh et al. . | |
| 5,601,015 | 2/1997 | Röttger et al. | 100/154 |
| 5,611,267 | 3/1997 | Lauderbaugh | 100/154 |
| 5,632,830 | 5/1997 | Marschke | 100/211 |

MACHINE FOR MANUGACTURING CORRUGATED BOARD

TECHNICAL FIELD

This invention relates to the corrugated board industry and, more particularly, to a machine for manufacturing corrugated board including one or more flexible, disposable covers for the pressure-applying feet of the machine.

BACKGROUND OF THE INVENTION

Corrugated board can be manufactured in many different widths and thicknesses. The thickness of the board is determined by the number of medians and liners in the board. First, corrugations or ridges are created in a median by passing the median through a corrugator. Then, an alternating series of liners and medians, with an adhesive between each layer, are brought together in a moving surface to form a board of desired thickness. The moving surface passes through an assembly line that includes a hotplate section, where heat and pressure are applied to dry the adhesive, and a cooling section, where the board is cooled. The moving surface is then cut and scored to make board of different shapes and sizes for boxes and other items.

The hotplate section includes a heat source, typically a series of steam chests, that heat the board to remove moisture and set the adhesive. A pressure applicator presses the board against the steam chest to ensure adhesion across the entire width of the board to prevent blisters from forming in the board. Because the steam chests tend to warp over time, usually with a sag in the middle, a rigid pressure applicator would crush the edges of the board and leave blisters in the middle. Many machines are also configured to manufacture board of varying width. These machines should be capable of varying the pressure applied across the machine because the edges of the board, which are only supported by adjacent board on one side, are easier to crush than the middle of the board. Multi-foot pressure applicators have therefore been developed for applying variable pressure across the width of a steam chest (i.e., in the cross-machine direction).

In addition, the hotplate section of a machine for manufacturing corrugated board usually includes several steam chests in the direction of machine flow. Pressure is applied over more steam chests for thicker board. For example, pressure may be applied over only one steam chest for a single median board, over two steam chests for a double median board, and over four steam chests for a triple median board. Thus, each steam chest typically has a corresponding row of pressure applicators. The resulting hotplate section includes a plurality of pressure-applying feet that are arranged in a grid. That is, the hot plate section includes a grid of pressure-applying feet including rows of feet in the cross-machine direction and columns of feet in the direction of machine flow.

This grid of pressure applicators allows a variable two-dimensional pressure profile to be applied to the moving surface that can be adjusted for board of different widths and thicknesses, as well as for variations in the steam chest surface. Each row is typically controlled independently, and the feet of each row may be controlled individually, or two or more adjacent feet may be grouped into commonly regulated zones, in the cross-machine direction. Such a machine is described in U.S. Pat. No. 5,611,267 (allowed application Ser. No. 08/567,948), which is entitled "Apparatus and Method of Applying Variable Pressure To A Surface In Corrugated Paperboard Manufacturing," inventor David Lauderbaugh, and which is incorporated herein by reference in its entirety.

In a conventional machine for manufacturing corrugated board, a conveyor belt in the hotplate section propels the board through the assembly line. The board is typically positioned directly above the steam chests and directly below the conveyor belt. The pressure applicators are located above the conveyor belt so that the pressure-applying feet bear directly against the conveyor belt. In other words, the pressure supplied to the pressure-applying feet is translated through the conveyor belt to the board. Thus, the conveyor belt and the feet are in sliding contact and under considerable pressure.

The resulting friction between the pressure-applying feet and the conveyor belt causes wear to both the feet and the belt. These parts, which are quite expensive and difficult to replace, therefore require frequent replacement. Worse yet, replacing these parts is a major maintenance event that requires shutting-down the entire assembly for an extended period. This is expensive, not only in terms of the cost of the parts, but also in terms of down time. There is, therefore, a need to maximize the life of the pressure-applying feet and the conveyor belt.

One way to reduce maintenance costs is to add a low-friction coating on the pressure-applying feet. This reduces the wear to both the feet and the conveyor belt. Many types of coatings, such as polished steel, TEFLON, and ceramic coatings, have been used. All of these coatings eventually wear off and the feet have to be replaced.

Another way to reduce maintenance costs is to remove the conveyor belt from the hotplate section of the assembly line. Some other conveying mechanism, such a pulling section located downstream from the hotplate section, can then be used to propel the board through the assembly line. There are a number of problems with this approach. First, wear to the conveyor belt is eliminated, but the pressure-applying feet still wear. Second, it is desirable to change the thickness of the board, by adding or removing adhering layers, while the board is moving through the assembly line. When a layer is added to the moving surface without the conveyor belt to span between adjacent feet in the direction of machine flow, the upstream edges of the feet can snag on the leading edge of the added layer. This destroys the board and requires a complete shut-down of the assembly line to restart the line for a board of desired thickness. There is, therefore, a need for an improved pressure applicator that allows the conveyor belt to be removed from the hotplate section of the assembly line.

Minimizing waste is another objective when manufacturing corrugated board. As noted previously, the board must be manufactured in a wide variety of widths for boxes and other items of different sizes. But corrugated board coming off the assembly line can only be manufactured in a limited number of widths corresponding to the columns of pressure-applying feet. This is because a column of pressure-applying feet must be positioned at or very near the edge of the board to ensure adhesion at the edge of the board. But the feet cannot significantly overlap the edge without crushing the flutes. Corrugated board is therefore usually manufactured in standard widths, corresponding to the columns of pressure-applying feet, and then trimmed to the desired size. Excessive trimming wastes board and increases the cost of the finished product. To minimize waste, it is advantageous to manufacture board in the size closest to the size of the desired finished product.

In summary, there is a need for a machine for manufacturing corrugated board that maximizes the life of the pressure-applying feet of the machine. There is also a need for a machine with a beltless hotplate section. There is a further need for a machine that minimizes trimming and the associated waste.

SUMMARY OF THE INVENTION

The present invention satisfies the needs described above by providing a machine for manufacturing corrugated board including one or more flexible, disposable covers for the pressure-applying feet of the machine. The covers prevent wear and tear to the bottoms of the pressure-applying feet and may be easily replaced, as needed. In a belt-driven machine, the disposable covers may be located between the pressure-applying feet and the conveyor belt. In a beltless machine, the conveyor belt is replaced by a pulling section located downstream from the pressure applicators and the disposable covers may be located between the pressure-applying feet and the moving surface. For the beltless machine, the covers allow the thickness of the corrugated board to be varied while the board is moving through the machine without causing the board to catch on the pressure-applying feet. In addition, the covers and/or the pressure-applying feet may be moved in the cross-machine direction to minimize waste when manufacturing different widths of corrugated board.

There are several types of disposable covers. For example, a cover may define a channel in the direction of machine flow for receiving a column of feet so that, when the feet are moved away from the surface, the feet engage the upper flanges of the channel to move the cover away from the moving surface. Another type of cover defines a flange substantially transverse to the direction of machine flow. This type of cover is well suited to a zone-actuated machine, in which a separate cover may be provided for each zone of pressure applicators. Alternatively, a sheet of protective material may be fastened to the feet of one or more columns of pressure applicators.

Generally described, the invention is a machine for applying variable pressure to a moving surface including a conveyor for moving a surface relative to a frame positioned proximate to the surface and a plurality of pressure applicators mounted on the frame. The pressure applicators form a grid of rows and columns of pressure applicators in which the rows are substantially transverse to the direction of movement of the surface and the colunms are substantially parallel to the direction of movement of the surface. Each pressure applicator includes a foot, a pressure device for biasing the foot away from the surface, and a variable pressure source that is operable for variably biasing the foot against the biasing force of the pressure device to move the foot away from the frame and toward the surface. The machine also includes a control device for varying the pressure supplied by each variable pressure source and a cover positioned between the moving surface and one or more feet. A hot surface, such as the steam chests of a machine for manufacturing corrugated board, may be positioned so that the surface moves between the hot surface and the cover.

The invention provides machines with belt-driven or beltless hotplate sections. For a belt-driven machine, the conveyor includes a movable belt positioned between the surface and the feet of the pressure applicators. For a beltless machine, the conveyor includes a pulling section located downstream from the pressure applicators. The pulling section may be any of variety of conventional devices for moving a surface relative to a frame, such as a opposing driven rollers, a conveyor belt, a vacuum drive unit, etc.

The invention also provides several different types of covers. A first type of cover defines a channel in the direction of machine flow including a bottom side adjacent to the moving surface, first and second edges connected to the bottom side and substantially orthogonal to the moving surface, and first and second upper flanges connected to the first and second edges. The cover is positioned so that a column of feet is positioned within the channel. Thus, when the feet are moved away from the surface, the feet engage the upper flanges of the channel to move the cover away from the moving surface. A machine using the first type of cover may also include a mechanism for moving the feet of the column and an associated cover in a direction substantially transverse to the direction of machine flow.

A second type of cover defines a flange substantially transverse to the direction of machine flow. The flange is positioned to engage the feet of a row of pressure applicators so that, when the feet are moved away from the surface, the feet engage the flange to move the cover away from the moving surface. A machine using the second type of cover may also include a mechanism for moving the feet of the row relative to the cover in a direction substantially transverse to the direction of machine flow.

A third type of cover includes a protective sheet that is fastened to the feet of one or more columns of pressure applicators. This is the simplest and, in some respects, the least expensive type of disposable cover.

The invention also provides a zone-actuated machine for manufacturing corrugated board that includes a conveyor for moving a surface relative to a frame positioned proximate to the surface and a plurality of pressure applicators mounted on the frame. The pressure applicators form a grid of rows and columns of pressure applicators in which the rows are substantially transverse to the direction of travel of the surface and the columns are substantially parallel to the direction of travel of the surface. Each pressure applicator includes a foot, a pressure device for biasing the foot away from the surface, and a variable pressure source that is operable for variably biasing the foot against the biasing force of the pressure device to move the foot away from the frame and toward the surface. The machine also includes a control device for varying the pressure supplied by each variable pressure source so that each row defines a plurality of zones of commonly-regulated adjacent pressure applicators. The machine also includes a plurality of flexible covers positioned between the moving surface and the feet so that each cover corresponds to a zone. A hot surface, such as the steam chests of a machine for manufacturing corrugated board, may be positioned so that the surface moves between the hot surface and the cover.

The disposable covers, which are in direct contact with the moving conveyor belt, prevent wear to the pressure-applying feet and may be easily replaced when worn out. The cost of a replacement cover is a fraction of the cost of a new set of pressure-applying feet. Down-time is also reduced because the cover can be replaced much more quickly than the pressure-applying feet. Moreover, the covers bridge the gaps between the feet of a column of pressure applicators so that the conveyor belt may be removed from the hotplate section of the assembly. The belt may then be replaced by a pulling section located downstream from the hotplate section of the assembly line.

Thus, it is an object of the invention to provide a machine for manufacturing corrugated board that includes one or more disposable, protective covers to maximize the life of the pressure-applying feet of the machine. It is a further object of the invention to provide a machine with a beltless hotplate section that includes a pulling section located downstream from the hotplate section of the assembly line. It is another object of the invention to provide a machine for manufacturing corrugated board that minimizes waste by including columns of feet that can be moved in the cross-machine direction to allow different widths of corrugated board to be manufactured. Additional features and advantages of the invention will become apparent from the following detailed description of the preferred embodiments and the appended drawings and claims.

DETAILED DESCRIPTION

Several embodiments of the present invention are described below. Each embodiment is a machine for manufacturing corrugated board that includes one or more flexible, disposable covers for the pressure-applying feet. In a belt-driven machine, the disposable covers may be located between the pressure-applying feet and the conveyor belt. In a machine with a beltless hotplate section, the conveyor belt is replaced by a pulling section located downstream from the pressure applicators and the disposable covers may be located between the pressure-applying feet and the moving surface. In addition, the covers and/or the pressure-applying feet may be moved in the cross-machine direction to minimize waste when manufacturing different widths of corrugated board.

Several types of covers are disclosed. For example, a cover may define a channel in the direction of machine flow for receiving a column of feet so that, when the feet are moved away from the surface, the feet engage the upper flanges of the channel to move the cover away from the moving surface. Another type of cover defines a flange substantially transverse to the direction of machine flow. This type of cover may be deployed in a zone-actuated machine, in which a separate cover may be provided for each zone of pressure applicators. Alternatively, a simple sheet of protective material may be fastened to the feet of one or more columns of pressure applicators.

Figure 1:
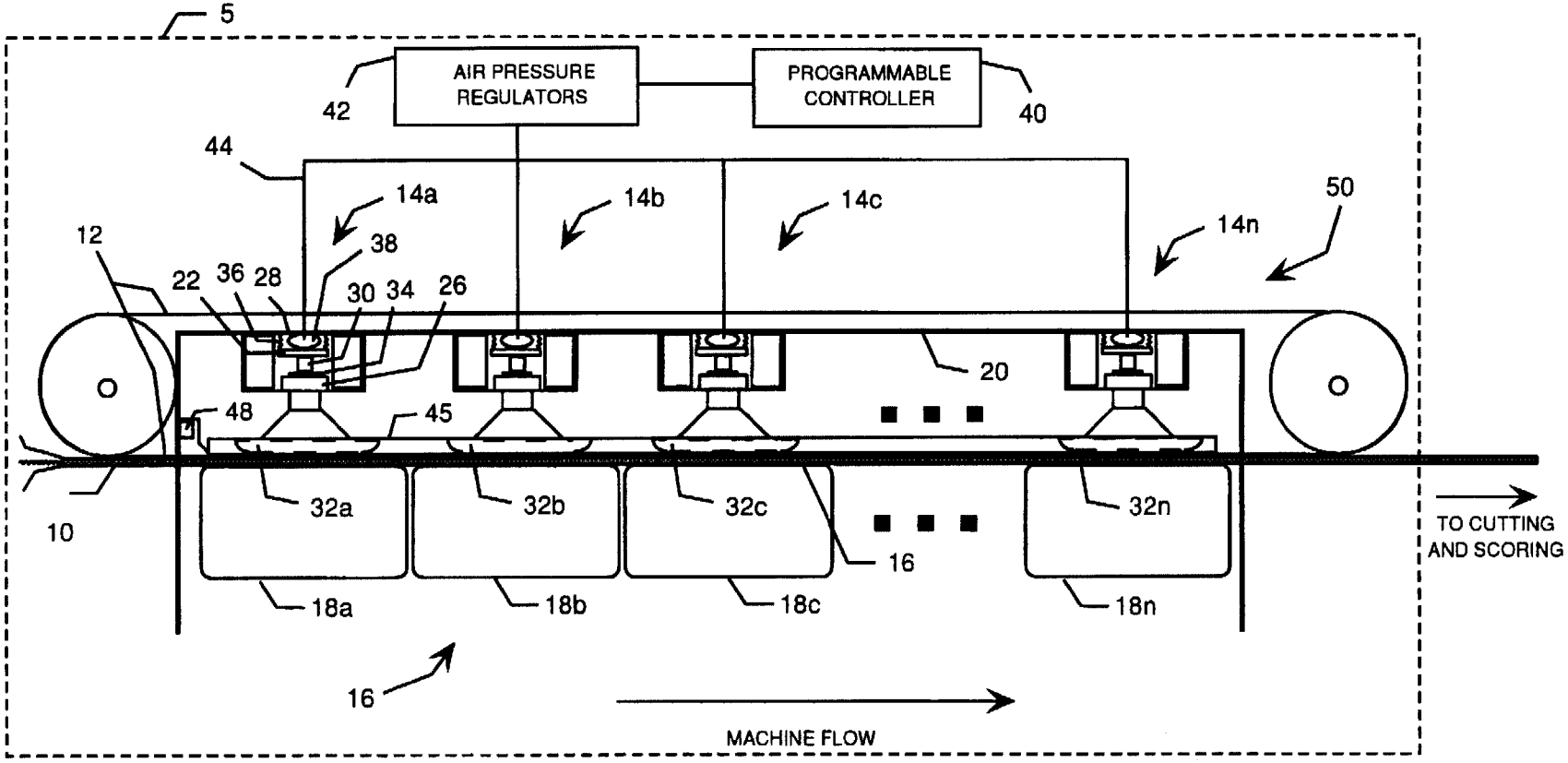
FIG. 1 is a diagram of the hotplate section of a belt-driven machine for manufacturing corrugated board according to the present invention.

Referring now to the drawings, in which like numerals indicate like elements, FIG. 1 is a diagram of the hotplate section 5 of a belt-driven machine for manufacturing corrugated board. The material entering the hotplate section 5 forms a moving surface including an alternating series of corrugated medians and substantially flat liners known as the adhering layers 10. The adhering layers 10 are in a liner/median/liner format in which the median is a corrugated section of the board sandwiched by upper and lower substantially flat liners. The adhering layers 10 may include additional median/liner pairs to increase the thickness of the board.

An adhesive is applied between each of the adhering layers 10 as they are brought together and fed into hotplate section 5, where heat and pressure are applied to set the adhesive and dry the adhering layers 10 to create corrugated board. While a conveyor belt 12 propels the adhering layers 10 through the hotplate section 5, a plurality of pressure applicators 14*a–n* apply pressure against the back of the conveyor belt 12 to press the adhering layers 10 against a hot surface 16 defined by the top surfaces of a plurality of steam chests 18*a–n*, which are heated by steam from a boiler (not shown).

The pressure applicators 14*a–n* are mounted on a frame 20 that is positioned above and proximate to the adhering layers 10. Referring to the representative pressure applicator 14*a*, each pressure applicator includes a loading plate 22 located between a bottom plate 26 and a cover plate 28. The bottom plate 26 and the cover plate 28 are rigidly attached to the frame 20 to prevent movement of the bottom plate 26 or the cover plate 28 toward or away from the adhering layers 10. A pressure rod 30 rigidly attaches the pressure-applying foot 32 to the loading plate 22. A linear bearing 34 that is press-fit into the bottom plate 26 vertical aligns the pressure rod 30. The bottom plate 26, through which the pressure rod 30 extends, is spaced apart from the loading plate 32 to allow the loading plate to move vertically relative to the frame 20, toward and away from the adhering layers 10.

Each pressure applicator includes a pressure device, such as springs represented by the spring 36, connected between the cover plate 28 and the loading plate 22. The springs 36 biasing the foot 32 away from the adhering layers 10. The space between the cover plate 28 and the loading plate 22 defines a sealed cavity that houses variable pressure source, such as the air bladder 38. The air bladder 36 may be inflated to variably bias the foot 32 against the biasing force of the springs 36 to move the foot 32 away from the frame 20 and toward the adhering layers 10.

The springs 36 preferably supply a sufficient biasing force so that the air bladder 38 may operate within a range in which the air bladder 38 exhibits desirable control characteristics, such as a linear relationship between the air pressure in the air bladder 38 and the downward force exerted by the foot 32. Specifically, acceptable control characteristics are realized if the air bladder 38 is an Airstroke® actuator two-ply bellows, model number W01-358-7451, made by Firestone, and each pressure applicator 14 includes four springs 36 that each apply approximately 100 lbs. of upward force on the foot 32. A typical foot 32 weighs approximately 50 lbs., the upward spring force exerted by the springs 36 is approximately 400 lbs, and the downward force exerted by the air bladder 38 may be varied from zero to approximately 458 lbs. or more. A downward force in the range of 0–108 lbs. may therefore be exerted on the conveyor belt 12 when the pressure applied by the air bladder 38 is in the range of 350–458 lbs.

This biasing configuration results in at least two advantages. First, it has been found that the air bladder 38 exhibits substantially more predictable control characteristics when operated at higher pressures, such as within the range of 350–458 lbs. In particular, the control characteristics for the air bladder 38 become increasingly unpredictable as the pressure approaches zero lbs. The biasing force of the springs 36 thus allows the air bladder 38 to operate with desirable control characteristics when producing the desired 0–108 lbs. loading range for the foot 32. Second, the springs 36 provide an easily-attained fail-safe condition in case of a loss of power. That is, the pressure applying foot 32 may be readily raised into a fail-safe position in case of a loss of power by automatically opening a bleed valve to release the air pressure in the air bladder 38.

Referring now to the entire hotplate section 5, this portion of the machine includes a plurality of columns of pressure applicators. The columns run in the direction of machine flow and are aligned to define rows of pressure applicators in the cross-machine direction. For example, FIG. 1 illustrates one such column, which includes the pressure applicators 14*a–n* in the direction of machine flow. The columns of pressure applicators thus form a grid 50 including rows of pressure applicators aligned in the cross-machine direction and columns of pressure applicators aligned in the direction of machine flow.

A computer, such as the programmable logic controller 41), controls a plurality of air pressure regulators 42, which are connected to the air bladders of the pressure applicators of the grid 50 by a network of pneumatic tubes 44. The programmable logic controller 40 controls the air pressure in each air bladder to finely control the pressure applied by the feet of the pressure applicators against the adhering layers 10. Advantageously, the pressure applied by each foot may be controlled independently by the programmable logic controller 40 to apply a desired two-dimensional pressure profile to the adhering layers 10. Thus, the grid 50 may apply a variable two-dimensional pressure profile to the moving surface 10 that can be adjusted for board of different widths and thicknesses, as well as for variations in the hot surface 16. To reduce the number of air pressure regulators 42, two or more adjacent feet may be grouped into commonly regulated zones in the cross-machine direction, or in the direction of machine flow, or both.

Turning now to an aspect of the belt-driven machine illustrated in FIG. 1 that significantly reduces maintenance costs, the hotplate section 5 includes a plurality of flexible, disposable covers, represented by the cover 45, that are positioned between the pressure-applying feet 32*a–n* and the conveyor belt 12. The cover 45 is attached to the support bar 48 using bolts, a flange that extends over the upstream side of the support bar 48, a ball bearing assembly, or another suitable type of fastener. The support bar 48 is attached to the frame 20 or to another suitable foundation to prevent the conveyor belt 12 from moving the cover 45 in the direction of machine flow.

It will be appreciated that the conveyor belt 12 and cover 45 are in sliding contact and under considerable pressure. Thus, the disposable cover 45, rather than the pressure applying feet 32*a–n*, wears as a result of the friction created with the conveyor belt 12. The disposable cover 45 is relatively inexpensive and easy to replace when worn out. The cover 45 therefore produces significant savings in maintenance expense because the cost of a replacement a cover 45 is a fraction of the cost of a new set of pressure-applying feet 32*a–n*. Down-time is also reduced because the cover 45 can be replaced much more quickly than the pressure-applying feet 32*a–n*.

Figure 2:
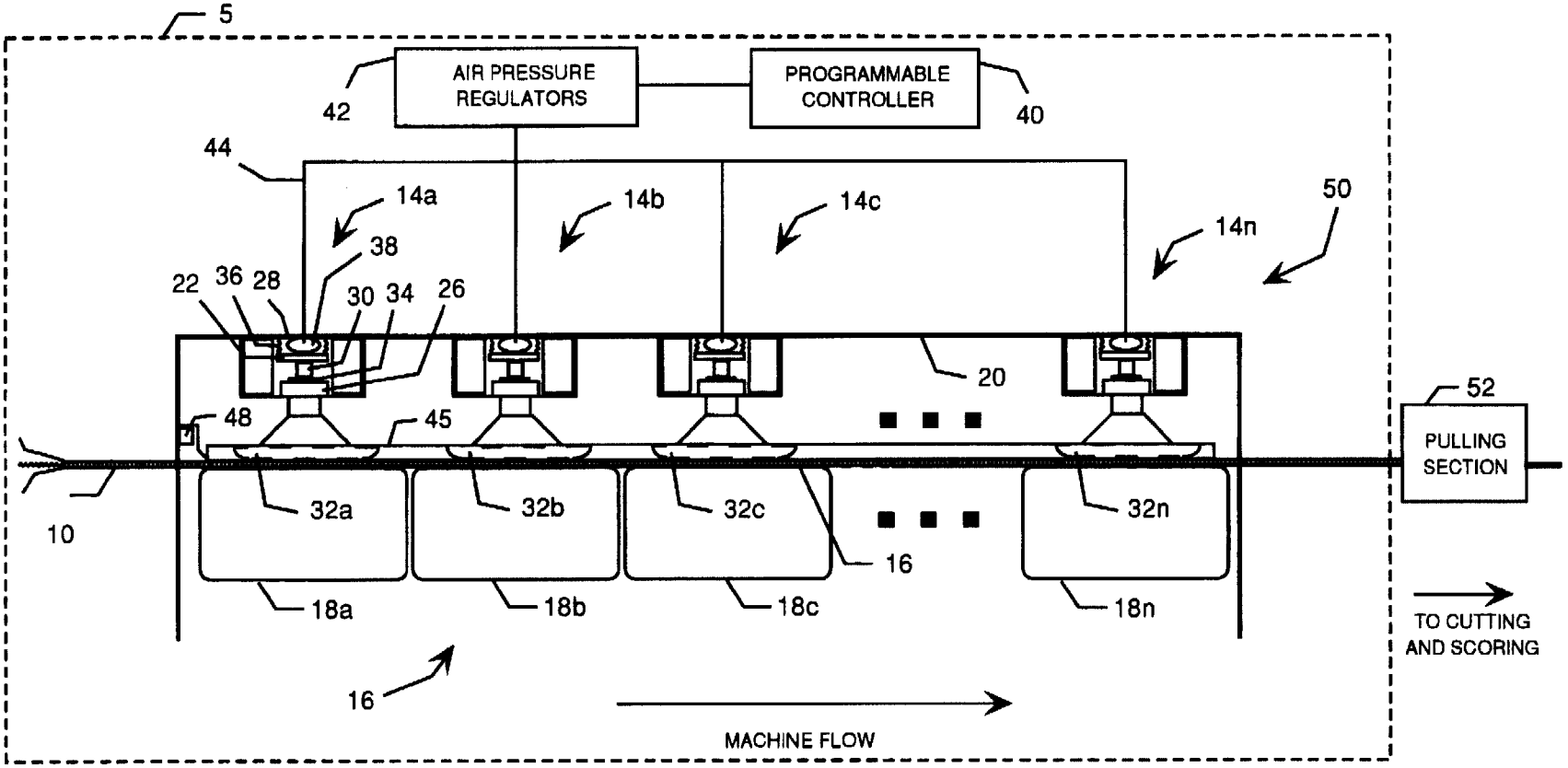
FIG. 2 is a diagram of a machine for manufacturing corrugated board including a beltless hotplate section according to the present invention.

FIG. 2 is a diagram of a machine for manufacturing corrugated board including a beltless hotplate section 5. This beltless machine is similar to the belt-driven machine illustrated in FIG. 1, except that the conveyor belt 12 of the belt-driven machine is replaced by a pulling section 52 that is located downstream from the hotplate section 5. The pulling section 52 may include any of variety of conventional devices for moving a surface relative to a frame, such as opposing driven rollers, a conveyor belt, a vacuum drive unit, etc. The cover 45 bridges the gaps between adjacent pressure-applying feet 32*a–n* in the direction of machine flow. This allows the thickness of the adhering layers 10 to be varied while the adhering layers 10 move through the hotplate section 5 without causing the leading edge of an added layer to catch on the upstream edges of the pressure-applying feet 32*a–n*.

The are several alternative types of covers. For example, FIG. 3A illustrates the cover 45 shown in FIGS. 1 and 2 in greater detail. The cover 45 defines a channel 60 that extends in the direction of machine flow to cover of one or more columns of adjacent feet, such as the column of pressure-applying feet 32*a–n*. The channel 60 includes a bottom side 62 adjacent and substantially parallel to the adhering layers 10, first and second edges 64*a–b* connected to the bottom side and substantially orthogonal to the adhering layers 10, and first and second upper flanges 66*a–b* connected to the first and second edges and substantially parallel to the adhering layers 10. The pressure-applying feet 32*a–n* are positioned within the channel 60 so that when the feet 32 are moved away from the adhering layers 10, the feet 32*a–n* engage the upper flanges 66*a–b* to move the cover 45 away from the adhering layers 10. As noted previously, the cover 45 is attached to the support bar 48 to prevent the cover 45 from moving in the direction of machine flow.

The cover 45 is very easy to replace. An operator simply detaches the cover 45 from the support bar 48 by removing the fasteners. The operator then slides the cover 45 off the column of feet 32*a–n*. The operator then slides a replacement cover 45 over the columns of feet 32*a–n*, and attaches the replacement cover 45 to the support bar 480 This is a quick and easy maintenance procedure compared to the alternative of replacing the feet 32*a–n* of the pressure applicators 14*a–n*. It will also be appreciated that the cover 45 is easy to manufacture by making a few cuts and straight bends to an appropriately-sized strip of stainless steel or another suitable material.

Another advantage of the cover 45 arises from the elimination of torque on the foot 32 of the pressure applicator 14. In a conventional hotplate section, the friction between the conveyor belt 12 and the foot 32 exerts considerable torque on the foot 32 in the direction of machine flow. This torque stresses the pressure rod 30 and the linear bearing 34 and wears these components of the pressure applicator 14. In a machine using the cover 45 illustrated in FIG. 3A, the support bar 48, rather than the foot 32 of the pressure applicator 14, bears the reaction force to the friction generated between the cover 45 and the conveyor belt 12. This reduces the wear and tear on the pressure rod 30 and the linear bearing 34.

Figure 3B:
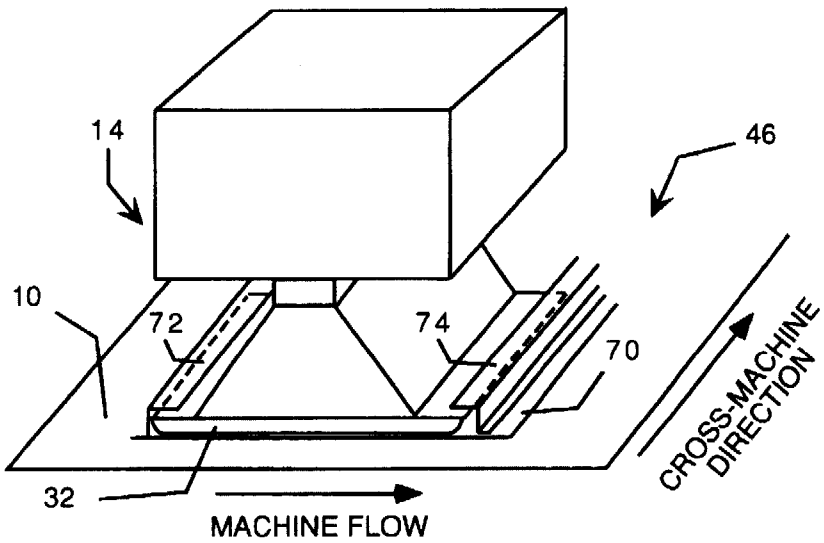
FIG. 3B illustrates a second type of cover for the feet of the pressure applicators of a machine for manufacturing corrugated board.
Figure 3A:
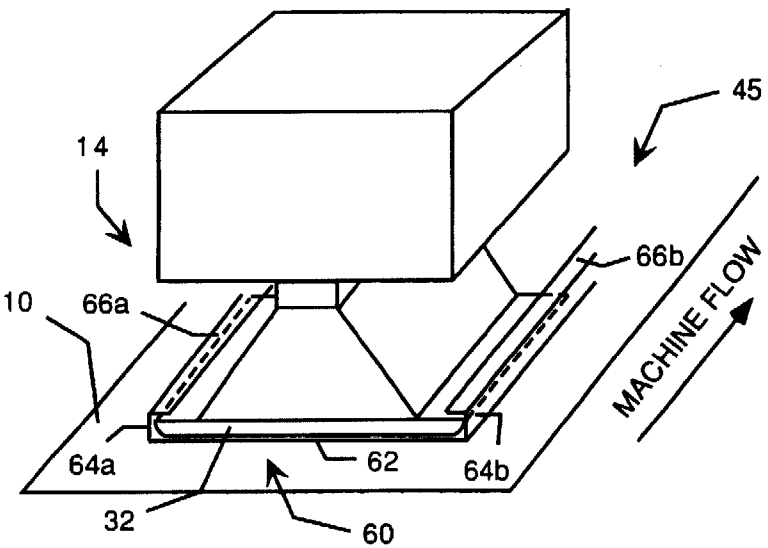
FIG. 3A illustrates a first type of cover for the feet of the pressure applicators of a machine for manufacturing corrugated board.

FIG. 3B illustrates a second type of cover 46 for the feet of one or more pressure applicators. The cover 46 includes a bottom side 70 adjacent and substantially parallel to the adhering layers 10 and a flange 72 that extends in the cross-machine direction. The cover 46 is positioned so that the up-stream edge of the foot 32 is between the flange 72 and the bottom side 70 of the cover 46. Optionally, the cover 46 may include a second flange 74 that engages the down-stream edge of the foot 32 of a pressure applicator 14. The flanges 72 and 74 may be extend in the cross-machine direction to engage the feet of one or more rows of pressure applicators.

The cover 46 does not require a support bar 48 because the engagement between the flange 72 and the foot 32 prevents the cover 46 from moving in the direction of machine flow. This engagement, however, imparts torque on the pressure applicator 14, which cause wear and tear to the pressure rod 30 and the linear bearing 34, as discussed previously. Therefore, the cover 46 may be attached to a support bar and positioned to alleviate the torque on the pressure applicator 14.

Figure 3C:
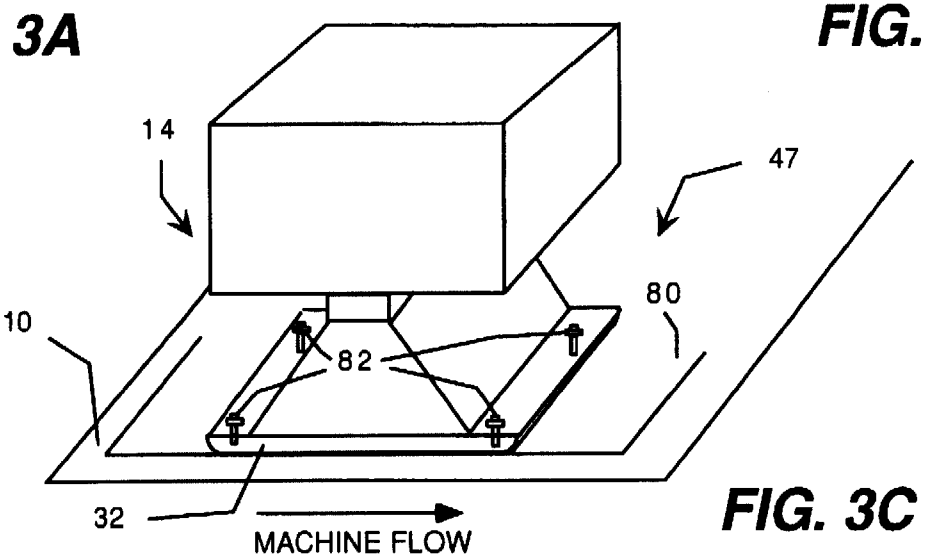
FIG. 3C illustrates a third type of cover for the feet of the pressure applicators of a machine for manufacturing corrugated board.

FIG. 3C illustrates a third type of cover 47 for the foot 32 of a pressure applicator 14. The cover 47 includes a flat sheet 80 adjacent to the adhering layers 10 and a plurality of fasteners 82 that connect the sheet 80 to the foot 32. The fasteners 82 are preferably inexpensive removable mechanical fasteners that form a smooth and approximately flush surface on the bottom side of the flat sheet 80, such as rivets or counter-sunk flat-head bolts or screws. The cover 47 has the advantage of being very inexpensive because it can be manufactured from a single sheet of stainless steel or another suitable material without making any bends. A technician simply orders or cuts the flat sheet 80 to the proper size and then drills holes in the appropriate places for the fasteners 82. It will be appreciated that the flat sheet 80 may be attached to any number of adjacent feet.

Figure 4B:
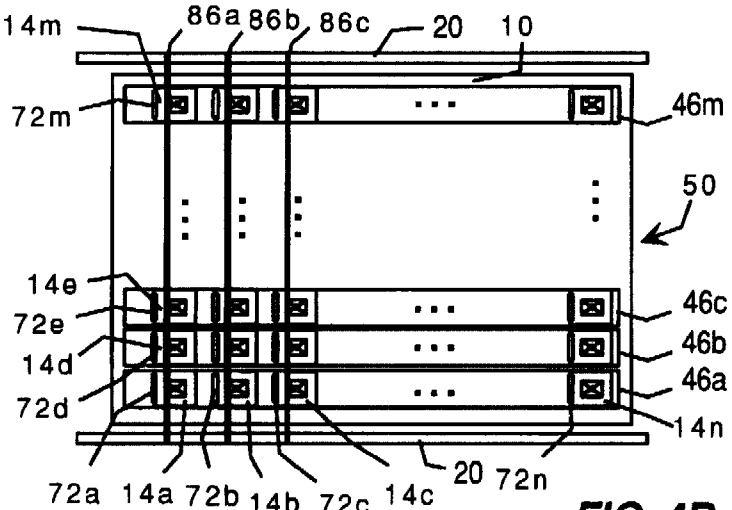
FIG. 4B is a top view of a machine for manufacturing corrugated board including a plurality of the covers shown in FIG. 3B.
Figure 4D:
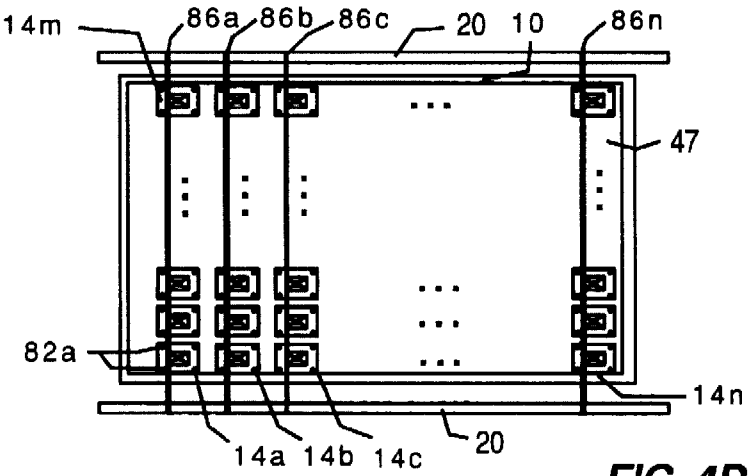
FIG. 4D is a top view of a machine for manufacturing corrugated board including the cover shown in FIG. 3C.
Figure 4A:
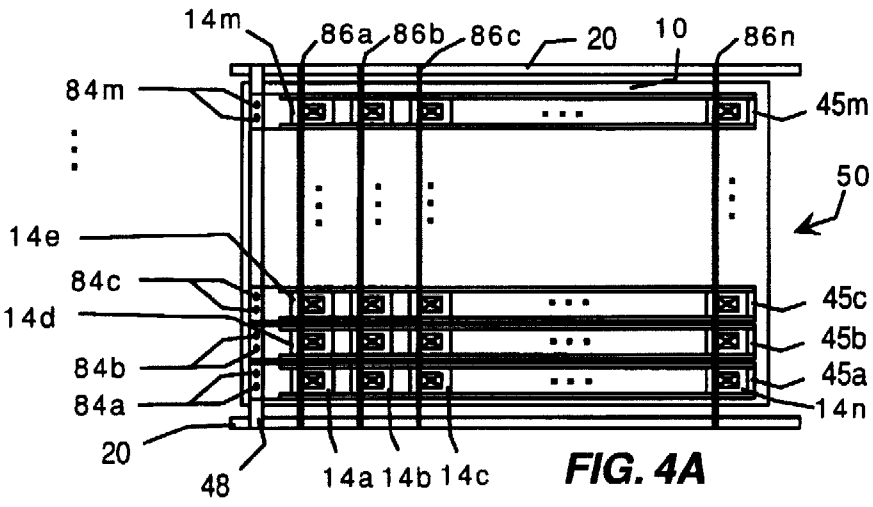
FIG. 4A is a top view of a machine for manufacturing corrugated board including a plurality of the covers shown in FIG. 3A.

FIG. 4A is a top view of a machine for manufacturing corrugated board including a plurality of the covers **45*a–n* shown in FIG. 3A. The grid 50 includes "n" rows of pressure applicators in the cross-machine direction and "m" columns of pressure applicators in the direction of machine flow. Each row of pressure applicators is connected to a cross member 86 that extends across the machine on the cross-machine direction. For example, the row including the pressure applicator 14*a* is connected to the cross member 86*a*, the row including the pressure applicator 14*b* is connected to the cross member 86*b*, the row including the pressure applicator 14*n* is connected to the cross member 86*n*, etc. Each cross member 86*a–n* is rigidly connected to the frame 20** or another suitable foundation.

In the machine illustrated in FIG. 4A, a first cover **45*a* extends in the direction of machine flow over the column including the pressure applicator 14*a*, a second cover 45*b* extends in the direction of machine flow over the column including the pressure applicator 14*d*, a third cover 45*m* extends in the direction of machine flow over the column including the pressure applicator 14*m*, etc. The cover 45*a* is connected to the support bar 48 with fasteners 84*a*, the cover 45*b* is connected to the support bar 48 with fasteners 84*b*, the cover 45*m* is connected to the support bar 48 with fasteners 84*m*, etc. The covers 45*a–m* are positioned so that the torque caused by the movement of the adhering layers 10 is borne by the support bar 48** rather than the pressure applicators. Although the machine illustrated in FIG. 4A includes a separate cover for each column of pressure applicators, a single cover could extend over a plurality of adjacent columns of pressure applicators.

FIG. 4B is a top view of a machine for manufacturing corrugated board including a plurality of the covers **46*a–n* shown in FIG. 3B. The machine illustrated in FIG. 4B includes a separate cover 46*a–n* for each column of pressure applicators. Thus, the cover 46*a* extends in the direction of machine flow over the column including the pressure applicator 14*a*, the cover 46*b* extends in the direction of machine flow over the column including the pressure applicator 14*b*, the cover 46*m* extends in the direction of machine flow over the column including the pressure applicator 14*m***, etc. Although the machine illustrated in FIG. 4B includes a separate cover for each column of pressure applicators, a single cover could extend over a plurality of adjacent columns of pressure applicators.

The cover **46*a* is positioned so that the up-stream edges of the feet of the pressure applicators 14*a–n* are between the flanges 72*a–n* and the bottom side 70 of the cover 46*a*. It will be appreciated that the engagement between the feet of the pressure applicators 14*a–n* and the flanges 72*a–n* prevents the cover 46*a* from moving in the direction of machine flow. The cover 46*m* is similarly positioned with respect to the column including the pressure applicator 14*m*, etc. Thus, for this embodiment, the support bar 48 is not required to support the cover 46*a–n***.

Figure 4C:
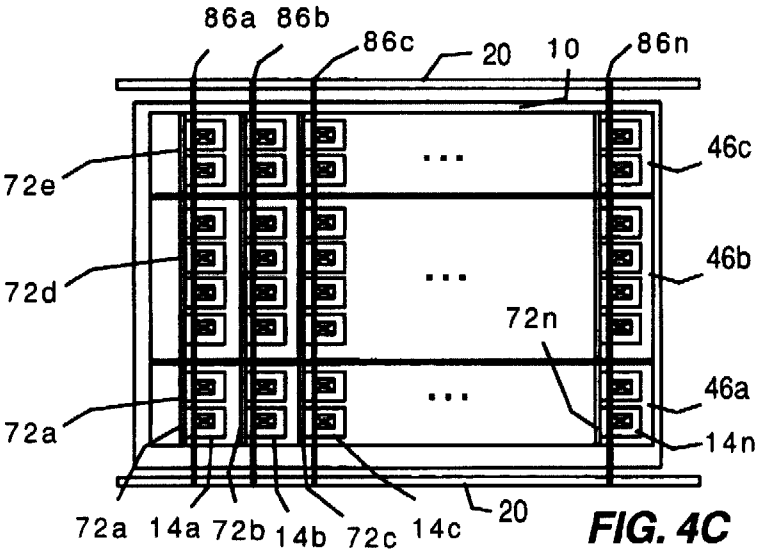
FIG. 4C is a top view of a zone-actuated machine for manufacturing corrugated board including a plurality of the covers shown in FIG. 3B.

FIG. 4C is a top view of a zone-actuated machine for manufacturing corrugated board including three covers **46*a–c* of the type shown in FIG, 3B. For this embodiment, each row of the grid 50 includes eight pressure applicators that are divided into three commonly regulated zones. The first zone includes the first two pressure applicators of the row, the second zone includes the center four pressure applicators of the row, and the third zone includes the last two pressure applicators of the row, A separate cover 46*a–c*** is provided for each zone and extends in the direction of machine flow over a plurality of adjacent zones of adjacent rows of pressure applicators.

Grouping the pressure applicators into commonly regulated zones reduces the number of air pressure regulators required for the machine. This reduces the cost and simplifies the operation of the machine. Although many different zone configurations may be employed, it has been found that a three-zone configuration, such as that shown in FIG. 4C, produces acceptable quality board with a minimum number of air pressure regulators per row in most situations.

To further reduce the number of air pressure regulators, adjacent zones of adjacent rows of pressure applicators may be commonly regulated. In other words, just like the rows of pressure applicators, each column of pressure applicators may be divided commonly regulated zones. For example, the pressure applicators associated with the cover **46*a* may be divided into several commonly-regulated zones in the direction of machine flow, the pressure applicators associated with the cover 46*b* may be divided into several commonly-regulate zones in the direction of machine flow, and the pressure applicators associated with the cover 46*c*** may be divided into several commonly-regulate zones in the direction of machine flow.

FIG. 4D is a top view of a machine for manufacturing corrugated board including a cover 47 of the type shown in FIG. 3C. This is the simplest type of cover, a single flat sheet 80 of stainless steel or another suitable material attached to the feet of the pressure applicators with fasteners 82. Although the machine illustrated in FIG. 4D includes a single cover for all of the pressure applicators, a separate cover may be provided for each column of pressure applicators, or for a plurality of adjacent columns of pressure applicators, or for any other type of two-dimensional zone of pressure applicators.

Figure 5:
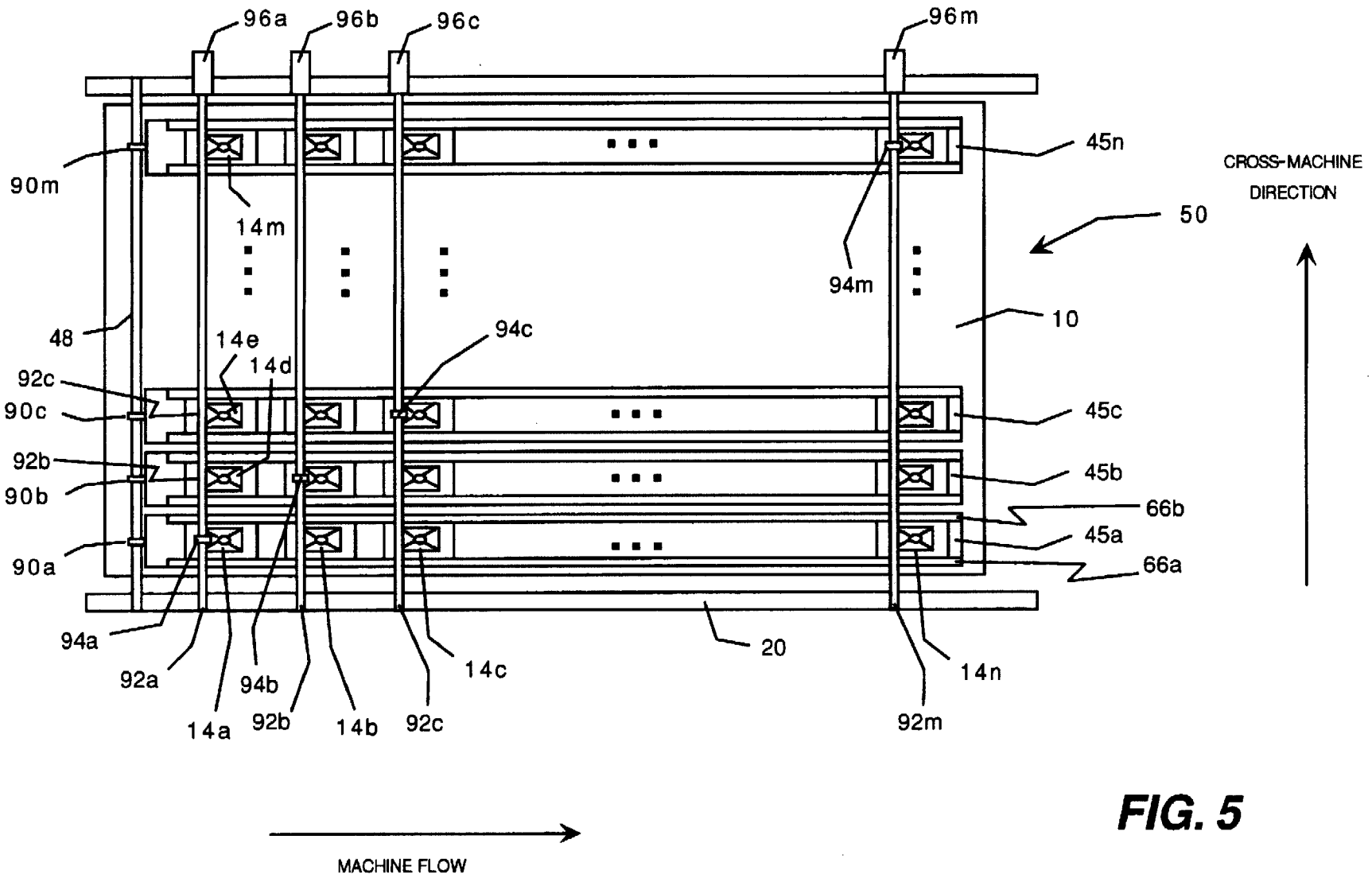
FIG. 5 is a top view of a machine for manufacturing corrugated board in which the pressure applicators and the associated covers may be moved in the cross-machine direction.

FIG. 5 is a top view of a machine for manufacturing corrugated board in which the pressure applicators and the associated covers may be moved in the cross-machine direction. The ability to move the pressure applicators and the associated covers in the cross-machine direction allows the machine to manufacture many different widths of board. In comparison, machines with non-movable pressure applicators can only manufacture board in a number of standard sizes. These standard sized are then cut to produce board of other desired widths. Thus, ability to move the pressure applicators reduces the amount of waste incurred in cutting the board to desired widths.

The machine illustrated in FIG. 5 includes a separate cover 45*a–n* for each column of pressure applicators. Thus, the cover 45*a* extends in the direction of machine flow over the column including the pressure applicator 14*a*, the cover 45*b* extends in the direction of machine flow over the column including the pressure applicator 14*d*, the cover 45*m* extends in the direction of machine flow over the column including the pressure applicator 14*m*, etc. The cover 45*a* is movably connected to the support bar 48 with a coupler 90*a*, such as a ball beating assembly, that allows the cover 45*a* to move relative to the support bar 48 in the cross-machine direction. Similarly, the cover 45*b* is movably connected to the support bar 48 with a coupler 90*b*, the cover 45*m* is movably connected to the support bar 48 with a coupler 90*m*, etc.

Each column of pressure applicators is connected to one of a plurality of ball screws 92*a–m* that extends across the machine on the cross-machine direction. For example, the column including the pressure applicator 14*a* is connected to the ball screw 92*a*, the column including the pressure applicator 14*d* is connected to the ball screw 92*b*, the column including the pressure applicator 14*m* is connected to the ball screw 90*m*, etc. Each ball screw 92*a–m* is connected by way of a ball nut 94*a–m* to a pressure applicator of the associated column. For example, the ball nut 94*a* connects the column including pressure applicator 14*a* to the ball screw 92*a*, the ball nut 94*b* connects the column including pressure applicator 14*d* to the ball screw 92*b*, the ball nut 94*m* connects the column including pressure applicator 14*m* to the ball screw 92*m*, and so forth.

Each ball screw 92*a–m* is connected to a rotary drive unit 96*a–m*, respectively, which is rigidly connected to the frame 20 or another suitable foundation. For example, the ball screw 92*a* is connected to the rotary drive unit 96*a*, the ball screw 92*b* is connected to the rotary drive unit 96*b*, and so forth. Thus, the rotary drive unit 96*a* may be operated to move the column including pressure applicator 14*a*, along with the cover 45*a*, in the cross-machine direction. Similarly, the rotary drive unit 96*b* may be operated to move the column including pressure applicator 14*d*, along with the cover 45*b*, in the cross-machine direction, and so forth. In addition, each pressure applicator that is not connected to a ball screw is slidably connected to at least one cross member that extends across the machine in cross-machine direction. Thus, each column forms a movable zone of pressure applicators.

It will be understood that the ball screws may be equivalently attached to the covers 45*a–n* rather than the pressure applicators. In this configuration, the support bar 48 should not be eliminated because it allows the covers 45*a–n* to be positioned so that the torque caused by the movement of the adhering layers 10 is borne by the support bar 48 rather than the ball screws. This minimizes wear to the ball screws and the ball nuts, and also prevents the ball screws from bowing in the direction of machine flow, which can cause the ball screws to crack and eventually fail.

Figure 6:
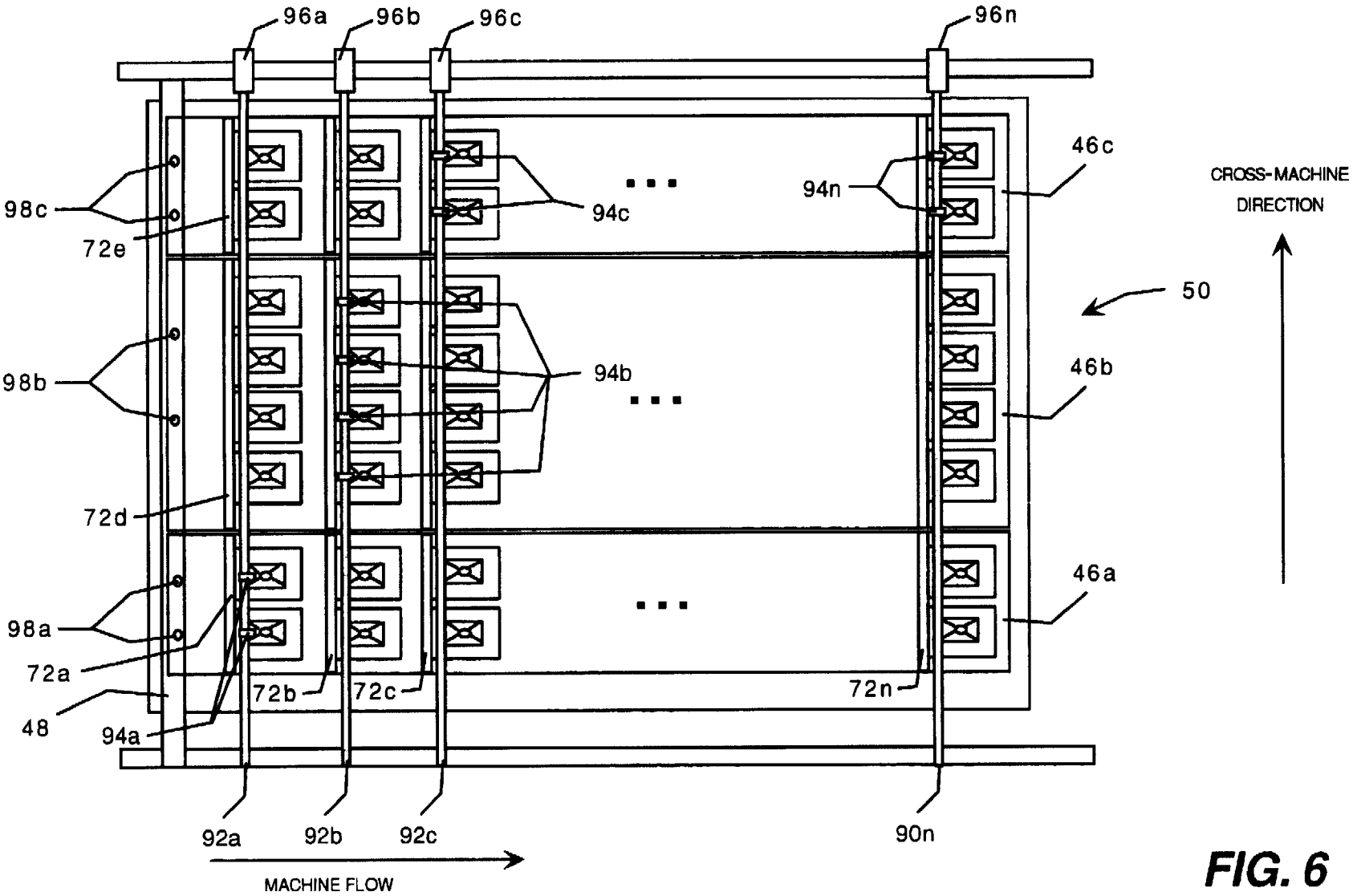
FIG. 6 is a top view of a zone-actuated machine for manufacturing corrugated board in which the pressure applicators may be moved in the cross-machine direction relative to the associated covers.

FIG. 6 is a top view of a zone-actuated machine for manufacturing corrugated board in which the pressure applicators may be moved in the cross-machine direction relative to the associated covers. In this embodiment, the covers 46*a–c* remain stationary relative to the frame 20, and the pressure applicators are movable relative to the covers 46*a–c*. The cover 46*a* is rigidly connected to the support bar 48 by way of the fasteners 98*a*, the cover 46*b* is rigidly connected to the support bar 48 by way of the fasteners 98*b*, and the cover 46*c* is rigidly connected to the support bar 48 by way of the fasteners 98*c*. Each zone of pressure applicators is independently movable relative to its associated cover by way of a ball screw assembly. Each ball screw assembly includes one of the ball screws 92*a–n*, one of the sets of ball nuts 94*a–n* (i.e., one ball nut for each pressure applicator of the zone), and one of the rotary drive units 96*a–n*.

The machine illustrated in FIG. 6 may include a separate ball screw assembly (i.e., a ball screw, a ball nut for each pressure applicator of the zone, and a rotary drive unit) for each zone of each row. This divides each row of pressure applicators into a plurality of movable zones. But the number of ball screw assemblies may be reduced by connecting adjacent pressure applicators in the direction of machine flow. This divides the grid 50 into a plurality of two-dimensional movable zones of pressure applicators. The movable zones may, but do not necessarily, correspond to the commonly regulated zones of pressure applicators described previously.

Referring to FIGS. 5 and 6, it should be understood that two ball screws are preferably provided for each movable zone of pressure applicators so that the movable zone may be aligned in the direction of machine flow. It should also be understood that each ball screw drive assembly described above may equivalently be replaced another suitable drive mechanism, such as a track and toothed gear assembly, a winch and cable assembly, a hydraulic piston assembly, a scissors-arm assembly, etc.

Referring now to all of embodiments described above, it should be appreciated that including a number of covers in the cross-machine direction allows the covers to be replaced separately, as needed. This is advantageous because the inner covers are used when manufacturing all widths of board, whereas the outer covers are only used for manufacturing relatively wide board. Thus, the inner covers wear more quickly and require replacement more frequently.

It should also be understood that each machine may include more than one bank of the covers in the direction of machine flow, provided that a mechanism, such as a support bar or an arcuate upstream edge, is provided to prevent the upstream edge of the cover from catching of the leading edge of an added adhering layer. This is advantageous because the upstream covers are used when manufacturing all thicknesses of board, whereas the downstream covers are only used for manufacturing relatively thick board. Thus, the upstream covers wear more quickly and require replacement more frequently.

Moreover, the pressure applicators may be grouped into a wide variety of configurations of commonly-regulated, commonly-movable, or commonly-covered zones. Many other machine configurations may therefore become apparent to those skilled in the art. Indeed, it is anticipated that each particular machine may experience a different usage and wear characteristic that could result in a particular machine configuration producing a preferred performance characteristic. The present invention provides for many different designs to meet these varying design challenges, including several cover designs, belt-driven and beltless machines, new and retrofit machines, individually and zone-actuated machines, and so forth.

The invention thus provides a machine for manufacturing corrugated board that includes one or more disposable, protective covers to maximize the life of the pressure-applying feet. The invention also provides a machine with a beltless hotplate section that includes a pulling section located downstream from the hotplate section of the assembly line. The invention also provides a machine for manufacturing corrugated board that minimizes waste by including columns of feet that can be moved in the cross-machine direction to allow different widths of corrugated board to be manufactured. It should be understood that the foregoing relates only to specific embodiments of the invention, and that numerous changes may be made therein without departing from the spirit and scope of the invention as defined by the following claims.

I claim:

1. A machine for applying variable pressure to a moving surface comprising:

a frame;

a conveyor for moving the surface relative and proximate to the frame;

a plurality of pressure applicators mounted on the frame, the pressure applicators forming a grid of rows and columns of pressure applicators, the rows being substantially transverse to the direction of movement of the surface, and the columns being substantially parallel to the direction of movement of the surface;

each pressure applicator comprising, a foot, a pressure device for biasing the foot away from the surface, and a variable pressure source operable for variably biasing the foot against the biasing force of the pressure device to move the foot away from the frame and toward the surface;

a control device for varying the pressure supplied by each variable pressure source; and a flexible removable cover positioned between the moving surface and one or more feet.

2. The machine of claim 1, wherein the conveyor comprises a movable belt positioned between the surface and the feet of the pressure applicators.

3. The machine of claim 1, wherein the conveyor comprises a pulling section located downstream from the pressure applicators.

4. The machine of claim 1, further comprising a hot surface positioned so that the surface moves between the hot surface and the cover.

5. The machine of claim 1, wherein:

the cover comprises a flange for engaging a foot so that, when the foot is moved away from the surface, the foot engages the flange to move the cover away from the moving surface.

6. The machine of claim 1, wherein:

the cover is fastened to the feet of a column of pressure applicators so that, when the feet are moved away from the surface, the cover moves away from the moving surface.

7. The machine of claim 1, wherein:

the cover defines a channel in the direction of machine flow comprising, a bottom side adjacent to the moving surface, first and second edges connected to the bottom side and substantially orthogonal to the moving surface, and first and second upper flanges connected to the first and second edges; and the cover is positioned so that a column of feet is positioned within the channel and, when the feet are moved away from the surface, the feet engage the upper flanges of the channel to move the cover away from the moving surface.

8. The machine of claim 7, further comprising:

means for moving the feet of the row and the cover in a direction substantially transverse to the direction of machine flow.

9. The machine of claim 1, wherein:

the cover defines a flange substantially transverse to the direction of machine flow; and the flange is positioned to engage the feet of a row of pressure applicators so that, when the feet are moved away from the surface, the feet engage the flange to move the cover away from the moving surface.

10. The machine of claim 9, further comprising:

means for moving the feet of the row relative to cover in a direction substantially transverse to the direction of machine flow.

11. A machine for applying variable pressure to a moving surface comprising:

a frame;

a conveyor for moving the surface relative and proximate to the frame;

a plurality of pressure applicators mounted on the frame, the pressure applicators forming a grid of rows and columns of pressure applicators, the rows being substantially transverse to the direction of travel of the surface, and the columns being substantially parallel to the direction of travel of the surface;

each pressure applicator comprising, a foot, a pressure device for biasing the foot away from the surface, and a variable pressure source operable for variably biasing the foot against the biasing force of the pressure device to move the foot away from the frame and toward the surface;

a control device for varying the pressure supplied by each variable pressure source so that each row of pressure applicators defines a plurality of zones of commonly-regulated adjacent pressure applicators; and a plurality of flexible removable covers positioned between the moving surface and the feet so that each cover corresponds to a zone.

12. The machine of claim 11, wherein the conveyor comprises a movable belt positioned between the surface and the feet of the pressure applicators.

13. The machine of claim 11, wherein the conveyor comprises a pulling section located downstream from the pressure applicators.

14. The machine of claim 11, further comprising a hot surface positioned so that the surface moves between the hot surface and the cover.

15. The machine of claim 11, wherein:

each cover defines a channel in the direction of machine flow comprising, a bottom side adjacent to the moving surface, first and second edges connected to the bottom side and substantially orthogonal to the moving surface, and first and second upper flanges connected to the first and second edges; and the cover is positioned so that one or more columns of feet corresponding to a zone are positioned within the channel and, when the feet are moved away from the surface, some or all of the feet engage the upper flanges of the channel to move the cover away from the moving surface.

16. The machine of claim 15, further comprising:

means for moving the feet of the row and the cover in a direction substantially transverse to the direction of machine flow.

17. The machine of claim 11, wherein:

the cover defines a flange substantially transverse to the direction of machine flow; and the flange is positioned to engage the feet of a row of pressure applicators so that, when the feet are moved away from the surface, the feet engage the flange to move the cover away from the moving surface.

18. The machine of claim 17, further comprising:

means for moving the feet of the row relative to cover in a direction substantially transverse to the direction of machine flow.

* * * * *